US006106921A

United States Patent [19]

Lancaster

[11] Patent Number: 6,106,921

[45] Date of Patent: Aug. 22, 2000

[54] FLOOR MATTING AND YARN FOR ITS MANUFACTURE

[75] Inventor: S. Spear Lancaster, Crownsville, Md.

[73] Assignee: Quill-Tuft, Inc., Odenton, Md.

[21] Appl. No.: 09/033,857

[22] Filed: Mar. 3, 1998

[51] Int. Cl.[7] ..... D05C 17/02; D02G 3/36; A47L 23/24

[52] U.S. Cl. ..... 428/92; 57/210; 57/227; 57/228; 15/215; 15/217

[58] Field of Search ..... 428/92, 222; 112/410; 57/210, 227, 228; 15/215, 217

[56] References Cited

U.S. PATENT DOCUMENTS 4,711,191 12/1987 Schwartz .
5,786,083 7/1998 Harris ..... 428/373

OTHER PUBLICATIONS

Quill–Tuft Advertisement of Four Seasons Flooring Inc., date unknown, Admitted to be prior art.
Quill–Tuft II Advertisement of Four Seasons Flooring, date unknown, Admitted to be prior art.
Quill–Tuft III specification, dated Aug. 29, 1997 (This Is Not Prior Art, Rather It Describes The Invention).

*Primary Examiner*—Terrel Morris
*Assistant Examiner*—Cheryl Juska
*Attorney, Agent, or Firm*—Birch, Stewart, Kolasch & Birch, LLP

[57] ABSTRACT

Entrance matting is made using a yarn comprising a wrapped bundle of thermoplastic strands having a maximum bundle thickness of 6600 denier and minimum bundle thickness of 5900 denier, with either ten or eleven strands, including a wrapping strand, with at least two, and no more than three, of these strands being monofilament strands and the remaining strands being multifilament strands, with each of the monofilament strands having approximately the same monofilament thickness as the other monofilament strands, said monofilament thickness being between 500 and 700 denier and each of the multifilament strands having approximately the same denier as the other multifilament strands.

25 Claims, 1 Drawing Sheet

FLOOR MATTING AND YARN FOR ITS MANUFACTURE

BACKGROUND OF THE INVENTION

This invention relates generally to floor matting and yarn for its manufacture but especially to entrance matting and matting for use in cleaning shoes.

In the past, shoe and boot cleaning mats, such as door mats and entrance mats, have been made of coco, rubber and the like. In more recent times, such matting has also been constructed of Nylon tufts with vinyl backing. Although nylon matting offers some advantages over earlier entrance matting, it has the disadvantages that it soils easily, it compresses in all directions (therefore it appears ragged), it fades in color, and it does not adequately clean shoes.

U.S. Pat. No. 4,711,191 to Schwartz discloses a monofilament-wrap texturizing product which basically describes a yarn formed as a bundle of heavy denier thermoplastic monofilament strands, which were helically wrapped. In practice the wrapping strand was a multifilament thermoplastic strand. This bundle, including all its strands, was then forced into a stuffer box crimper which randomly crimped all of the strands. As noted above, all of the wrapped strands used for making the yarn in this patent were monofilaments.

Yarn manufactured in the general manner described in U.S. Pat. No. 4,711,191 to Schwartz has been used as tufts for making entrance matting for a number of years. Although this entrance matting has been remarkably efficient in cleaning footwear of people walking on the matting, it has also had the disadvantages that it has been rather course and feels hard. Further, it has been almost impossible to clean.

In recent years, multifilament strands have been mixed in yarn bundles for manufacturing entrance matting which is somewhat softer in feel but yet which also has good footwear-cleaning characteristics. In this regard, one such mixture that has been on the market has had approximately 50% multistrands and 50% monostrands. Matting of such yarn has been manufactured for about two years. Although this matting can be cleaned better than could matting constructed purely of monofilament yarn as was described by Schwartz in U.S. Pat. No. 4,711,191, it still has the difficulty that thread-like debris on the matting cannot be easily removed by commercial cleaning equipment. Thus, thread-like debris which engages such matting must be cleaned by individuals leaning over and removing it by hand.

Thus, it is an object of this invention to provide a yarn for making matting, and the matting itself, which can efficiently clean footwear of individuals stepping on the matting, which has a relatively soft feel, and which can be cleaned by commercial cleaning equipment.

SUMMARY OF THE INVENTION

According to principles of this invention, entrance matting is made using a yarn comprising a wrapped bundle of thermoplastic strands having a maximum bundle thickness of 6600 denier and minimum bundle thickness of 5900 denier, with either ten or eleven strands, including a wrapping strand, with at least two, and no more than three, of these strands being monofilament strands and the remaining strands being multifilament strands, with each of the monofilament strands having approximately the same monofilament thickness as the other monofilament strands, said monofilament thickness being between 500 and 700 denier and each of the multifilament strands having approximately the same denier as the other multifilament strands.

In a preferred embodiment, all of the strands are of polypropylene and all have heat-set bends. In one embodiment in which a matting made with the yarn is ⅝ inch thick, the yarn has eight multistrands and three monostrands and in an embodiment in which the matting is ⅜ inch thick, the yarn has nine multistrands and two monofilament strands (including a wrapping strand). In each case each of the multifilament strands has a denier of 600 with 12 filaments and each of the monofilament strands has a thickness of 595 denier.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE INVENTION

Figure 1:
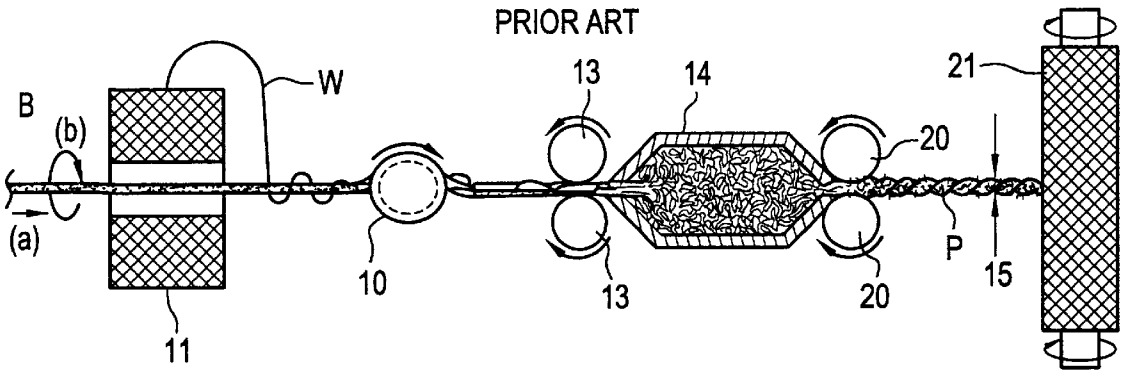
FIG. 1 PRIOR ART
FIG. 1 is a schematic side elevation view, with certain parts cut away and shown in section, of prior art apparatus for producing a prior art yarn and yarn of this invention.

Prior art apparatus described in U.S. Pat. No. 4,711,191 to Schwartz for making yarn is depicted in FIG. 1. In this apparatus a bundle B of strands are drawn from round supply tubes of packaged strands in a direction of arrow (a). A wrapping strand W, mounted for rotation in a direction of arrow (b) is shown in FIG. 1. The bundle B is caused to advance continuously through a center opening of a package 11, with rotation of the package 11 wrapping the wrapping strand W in a helical configuration about the bundle B. The thusly wrapped bundle is conducted around a heated godet 10 for heating the bundle. The heated wrapped bundle is driven by feed rolls 13 which drive the bundle into a stuffer box crimper 14, wherein the individual strands of the wrapped bundle B buckle and fold upon themselves to form a multiplicity of zigzag crimps. Material within a chamber of the stuffer box crimper 14 is pulled out by rolls 20 at a constant speed slower than an "in" speed of rolls 13 to thereby produce a yarn P which is wound into a roll 21.

Figure 2:
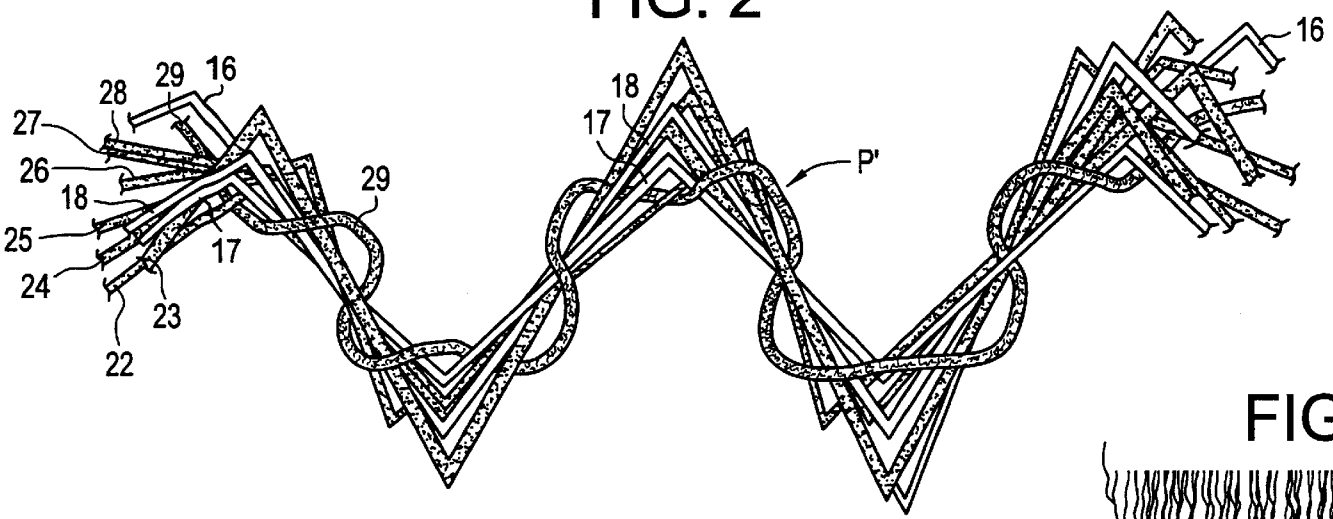
FIG. 2 is schematic view, greatly enlarged, showing features of a yarn product of this invention; and, FIG. 3 is a schematic view, in cross-section, of floor matting made with tufts of yarn of this invention.
Figure 3:
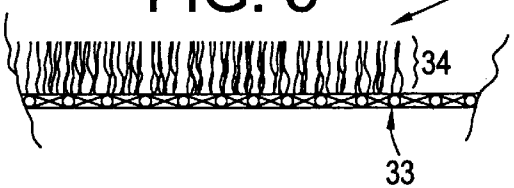

FIG. 2 depicts schematically, in an enlarged manner, one embodiment of yarn P' in accordance with this invention which is made using generally the prior-art method depicted in FIG. 1. In this particular embodiment, a thickness 15 (shown in FIG. 1) of a yarn P' is 6585 denier. In addition, the bundle B from which the yarn P' is made comprises three monofilament strands 16, 17, and 18 (shown as white strands in FIG. 2) and eight multifilament strands 22–29 (shown as shaded strands in FIG. 2). It should be noted that one of these multifilament strands 22–29, namely, multifilament strand 29, is a wrapping strand. Each of the multifilament strands 22–29 has a thickness of 600 denier with 12 filaments, and is therefore designated as being a 600/12 multifilament strand.

Each of the monofilament strands 16, 17 and 18 has a thickness of 595 denier.

Thus, the yarn P' is made up of 72.7% multifilament strands and 27.3% monofilament strands. The crimps in the yarn which are created by the heat godet and the stuffer box crimper 14 are shown schematically in FIG. 2. It should be understood that the total bundle thickness 15 is approximately the sum of the thicknesses of the individual strands, although this cannot easily be seen from the drawings.

The yarn P' of the embodiment described above is cut into lengths slightly longer than 2×⅝ inch and then each length is doubled over to form two ⅝ inch tufts. The doubled over portion of the two ⅝ inch tufts are attached to a backing 33 of woven, doublebacked polypropolene.

Thus, ⅝ inch tufts 34 are attached to the backing 33 to form a entrance matting 35.

In a second embodiment of this invention (not shown in the drawings), there are only two monofilament strands and there are nine multifilament strands. Again, the monofilament strands have a thickness of 595 denier and the multifilament strands are 600/12 multifilament strands. Thus, the total thicknesses of all the strands are 6590 denier.

Yarn made in accordance with the second embodiment is usually used for making entrance matting having ⅜ inch tufts. In this regard, the matting made with yarn of the second embodiment is somewhat softer than matting made with the yarn of the first embodiment; however, the shorter tufts are inherently somewhat stiffer to compensate for the softness of the yarn.

The yarn made with this invention, and matting tufts made from this yarn, must be made with strands having a sum of thicknesses which is not greater than 7000 but which is also not less than 5000. Further, the yarn must have at least ten strands, but not a greater number of strands than eleven. Still further, there must be at least two monofilament strands, but not more than three monofilament strands, each having the same thickness and that thickness falling between 500 and 700 denier. Finally, the remaining strands must be multifilament strands, each having the same thickness.

In the preferred embodiment of this invention, thermoplastic monofilament strands and multifilament strands are made of polypropylene.

It should be noted that in the ⅝ inch tuft embodiment, the monofilament strands contribute about 27% of the sum of thicknesses of all the strands while in the ⅜ inch tuft embodiment the monofilament strands contribute about 18% of the sum of the thicknesses of all of the strands. It presently appears that this monofilament/total percentage must fall between 15%–30% for this invention to properly function.

It has been ascertained that a matting made with yarn manufactured to have the structure as set forth above cleans footwear almost as well as does matting made completely of monofilament yarn as taught in U.S. Pat. No. 4,711,191 to Schwartz. In addition, however, matting made in accordance with tufts of yarn of this invention is much softer in feel than is either the matting made in accordance with U.S. Pat. No. 4,711,191 to Schwartz or prior-art matting which has 50% multistrands and 50% monofilament strands. But, even more importantly, matting made with yarn of this invention can be entirely cleaned with commercial cleaning equipment. In this regard, even thread-like debris caught in the matting can be removed by cleaning equipment without requiring cleaning personnel to hand remove it.

Yet another benefit of this invention is that the yarn can be manufactured at fast speeds without breaking, which it often does if the yarn is an inappropriate thickness.

Also, matting made with this yarn has an appropriate "body" even when stitches are not placed unduly close together. Thus, the matting can be manufactured relatively inexpensively.

Still another benefit of this invention is that the wrapping strand can have a smaller winding pitch (the windings can be further apart) than could the windings of the prior art. In the prior art the wrapper windings were spaced ½ inch apart and it presently appears that in the yarn of this invention the wrapper windings can have a spacing of up to ¾ inch, thereby increasing the speed at which the yarn can be manufactured.

While this invention has been described in relation to two embodiments, it will be understood that other embodiments are possible within the scope of the invention. For example, it may be possible to incorporate small additional strands into the bundle B if the total thicknesses of such additional strands is so small that it does not substantially change the dimension relationships described above.

The invention claimed is:

1. A floor matting of tufts made of a stiff, pliable texturized yarn comprising a wrapped bundle of a plurality of thermoplastic strands with a wrapping strand wrapping about the other strands in said bundle in a spiraled manner, said strands including a plurality of equal-denier thickness monofilament strands and a plurality of equal-denier thickness multifilament strands;

wherein there is a maximum sum of thicknesses of the strands of 7000 denier and a minimum sum of thicknesses of the strands of 5000 denier with this sum of thicknesses being substantially provided by no more than eleven strands in the bundle, including the wrapping strand, and no fewer than ten strands with at least two of these strands, and no more than three, being equal denier thickness multifilament strands, said monofilament strands having a thickness above 550 denier and less than 650 denier.

2. A floor matting as in claim 1, wherein all of said strands are made of polypropylene.

3. A floor matting as in claim 1, wherein all of the strands have heat set bends therein.

4. A floor matting as in claim 1, wherein there are eight multifilament strands and three monofilament strands.

5. A floor matting as in claim 1, wherein there are nine multifilament strands and two monofilament strands.

6. A floor matting as in claim 1 wherein said wrapping strand is a multifilament strand.

7. A floor matting as in claim 6, wherein each of said multifilament strands is a 600/12 multifilament strand.

8. A floor matting as in claim 7, wherein substantially all said strands are made of polypropylene.

9. A floor matting as in claim 7, wherein each of said monofilament strands has a thickness of 595 denier.

10. A floor matting as in claim 9, wherein said strands are made of polypropylene.

11. A floor matting as in claim 1, wherein each of said monofilament strands has a monofilament thickness of 595 denier.

12. A floor matting as in claim 11, wherein said strands are made of polypropylene.

13. A stiff pliable textured yarn comprising a wrapped bundle of thermoplastic strands with a wrapping strand wrapping about the other strands in said bundle in a spiraled manner;

wherein there is a maximum sum of thicknesses of the strands of 7000 denier and a minimum sum of thicknesses of the strands of 5000 denier with this sum of thicknesses being substantially provided by no more than eleven strands in the bundle, including the wrapping strand, and no fewer than ten strands with at least two of these strands, and no more than three, being equal denier thickness multifilament strands, said monofilament strands having a thickness above 550 denier and less than 650 denier.

14. A stiff pliable textured yarn as in claim 13, wherein all of said strands are made of polypropylene.

15. A stiff pliable textured yarn as in claim 13, wherein all of the strands have heat set bends therein.

16. A stiff pliable textured yarn as in claim 13, wherein there are eight multifilament strands and three monofilament strands.

17. A stiff pliable textured yarn as in claim 13, wherein there are nine multifilament strands and two monofilament strands.

18. A stiff pliable textured yarn as in claim 13 wherein said wrapping strand is a multifilament strand.

19. A stiff pliable textured yarn as in claim 18, wherein each of said multifilament strands is a 600/12 multifilament strand.

20. A stiff pliable textured yarn as in claim 19, wherein substantially all said strands are made of polypropylene.

21. A stiff pliable textured yarn as in claim 19, wherein each of said monofilament strands has a thickness of 595 denier.

22. A stiff pliable textured yarn as in claim 21, wherein said strands are made of polypropylene.

23. A stiff pliable textured yarn as in claim 13, wherein each of said monofilament strands has a monofilament thickness of 595 denier.

24. A stiff pliable textured yarn as in claim 23, wherein said strands are made of polypropylene.

25. A floor matting of tufts made of a stiff, pliable texturized yarn comprising a wrapped bundle of a plurality of thermoplastic strands with a wrapping strand wrapping about the other strands in said bundle in a spiraled manner, said strands including a plurality of equal-denier thickness monofilament strands and a plurality of equal-denier thickness multifilament strands;

wherein there is a maximum sum of thicknesses of the strands of 7000 denier and a minimum sum of thicknesses of the strands of 5000 denier with this sum of thicknesses being substantially provided by no more than 30% monofilament strands in the bundle and no fewer than 15% monofilament strands in the bundle.

* * * * *